United States Patent [19]

Woods et al.

[11] Patent Number: 4,640,762

[45] Date of Patent: Feb. 3, 1987

[54] PROCESS FOR IMPROVING THE YIELD OF DISTILLABLES IN HYDROGEN DONOR DILUENT CRACKING

[75] Inventors: H. John Woods, Campbellville; Frank Souhrada, Islington, both of Canada

[73] Assignee: Gulf Canada Corporation, Calgary, Canada

[21] Appl. No.: 752,710

[22] Filed: Jul. 8, 1985

[51] Int. Cl.[4] ..... C10G 47/34; C10G 65/12

[52] U.S. Cl. ..... 208/56; 208/96; 208/107

[58] Field of Search ..... 208/56, 59, 92, 94, 208/96, 107

[56] References Cited

U.S. PATENT DOCUMENTS

| | | | |
|---|---|---|---|
| 2,772,213 | 11/1956 | Fischer | 208/56 |
| 2,953,513 | 9/1960 | Langer, Jr. | 208/56 |
| 3,775,293 | 11/1973 | Watkins | 208/86 |
| 4,176,048 | 11/1979 | Corns et al. | 208/59 |
| 4,200,519 | 4/1980 | Kwant et al. | 208/77 |
| 4,294,686 | 10/1981 | Fisher et al. | 208/56 |
| 4,395,324 | 7/1983 | Derbyshire et al. | 208/56 |
| 4,400,264 | 8/1983 | Kwant et al. | 208/68 |
| 4,454,023 | 6/1984 | Lutz | 208/96 |
| 4,454,024 | 6/1984 | Singhal et al. | 208/111 |
| 4,465,587 | 8/1984 | Garg et al. | 208/87 |
| 4,500,416 | 2/1985 | Van Dongen et al. | 208/86 |

*Primary Examiner*—Olik Chaudhuri

*Attorney, Agent, or Firm*—Bert J. Lewen; Henry Sternberg

[57] ABSTRACT

A process is disclosed for converting a heavy hydrocarbon oil feedstock to produce a high yield of lower-boiling hydrocarbons, wherein a residuum fraction of the effluent from a hydrogen donor diluent hydrocracking reactor is deasphalted using a low-boiling solvent and at least the highest-boiling fraction of the deasphalted oil is recycled to the hydrogen diluent hydrocracking zone.

9 Claims, 2 Drawing Figures

PROCESS FOR IMPROVING THE YIELD OF DISTILLABLES IN HYDROGEN DONOR DILUENT CRACKING

This invention relates to a process for upgrading high-boiling, hydrocarbon oils to produce lower-boiling hydrocarbons.

Hydrogen donor diluent hydrocracking has been known for many years for upgrading heavy, high-boiling hydrocarbon oils, including tar sands bitumen of the Athabasca type and residua thereof. In such processes, a feedstock, which can be whole bitumen but is more commonly an atmospheric or vacuum residuum, is treated at elevated temperatures with a hydrogen-donating hydrocarbon in the absence of catalyst. The hydrogen-donating hydrocarbon is generally a partially hydrogenated aromatic material, boiling in the range from about 180° C. to 450° C., for example tetralin, substituted tetralins and partially hydrogenated three- and four-fused-ring aromatic compounds. One such process is disclosed in Canadian Pat. No. 1,122,914. In that process an Athabasca tar sands bitumen was upgraded by hydrocracking its residuum in the presence of a recycled hydrogen donor material obtained by separating particular portions of the effluent from the donor hydrocracking zone and catalytically rehydrogenating a specific portion so produced.

In U.S. Pat. No. 2,953,513, it was disclosed that certain distillate thermal tars boiling above 371° C. will, when partially hydrogenated, produce a hydrogen donor material suitable for hydrocracking heavy feedstocks at temperatures above 427° C. A portion of the required hydrogen donor material could be supplied by rehydrogenation of a particular fraction of the product materials from the thermal hydrocracking stage.

Solvent deasphalting is a well-known method for separating petroleum residua into an asphaltene fraction which contains a high proportion of the highest molecular weight compounds, together with inorganic matter and other compounds which are substantially insoluble in the selected solvent, and a deasphalted, lower molecular weight oil fraction which is relatively more soluble in the solvent. In the practice of deasphalting by solvent extraction, the deasphalting feedstock is mixed with a solvent chosen for its ability selectively to dissolve desirable low molecular weight hydrocarbons and to reject by precipitating them, the high molecular weight hydrocarbons and other low-value materials mentioned above. Most commonly used as solvents in this process are low-boiling aliphatic hydrocarbons including propane, butane, pentane, hexane and heptane and the corresponding mono-olefins. The solvent-to-feedstock ratio is chosen together with the solvent type so that the optimum separation of desirable low-boiling hydrocarbons is obtained.

Solvent deasphalting has been combined with certain other upgrading steps. For example, Watkins in U.S. Pat. No. 3,775,293 disclosed the deasphalting of a black hydrocarbonaceous oil combined with deresining of the deasphalted oil and separate catalytic hydrotreatment of the resins and the deresined oil. In addition, the bottoms of the hydrotreated resins product was thermally cracked and the thermal cracker effluent was fed together with the deasphalted oil to one of the catalytic hydrotreatment zones.

In U.S. Pat. No. 4,200,519, Kwant et al disclosed the combination of multiple thermal cracking zones with the deasphalting of the residuum of the first thermal cracking zone. The deasphalted oil was fed together with certain components from the first thermal cracking zone, to a second thermal cracking zone.

In U.S. Pat. No. 4,400,264, Kwant et al described a process in which a deasphalting step was combined with multiple thermal cracking zones and a catalytic hydrotreating zone. The material fed to the catalytic hydrotreating step was comprised of the bottoms from each of the thermal cracking zones and the rejected material, primarily asphaltenes, from the deasphalting zone.

The present invention is concerned with increasing the production of distillable materials from bitumens and other heavy oils, and provides a process for converting a feedstock comprising a heavy, high-boiling hydrocarbon oil residuum to produce lower-boiling hydrocarbons, comprising:

(a) thermally hydrocracking said feedstock with hydrogen donor diluent in a hydrogen donor diluent cracking zone, producing a hydrocracked product stream, (b) fractionating said hydrocracked product stream into at least one distillable fraction and a hydrocracked residuum fraction, (c) contacting said hydrocracked residuum fraction with an extracting solvent to produce a deasphalted oil fraction and an asphaltenes-rich residue, (d) recycling said deasphalted oil fraction as a recycle stock, and (e) thermally hydrocracking said recycle stock in said hydrogen donor diluent cracking zone together with said first residuum fraction.

BRIEF DESCRIPTION OF THE FIGURES

In drawings that illustrate preferred embodiments of the invention.

All boiling points described in the present disclosure and claims refer to a pressure of one atmosphere, and all yields and compositions are expressed in weight percent, unless otherwise noted.

The process of the invention also comprehends fractionating the deasphalted oil fraction obtained in the extraction zone to obtain at least one deasphalted oil distillate fraction and a deasphalted oil bottoms fraction, and returning the deasphalted oil bottoms fraction as the recycle stock. The feedstock can be atmospheric or vacuum residuum of conventional crude or of heavy oil, for example Lloydminster, Saskatchewan, or of oil sands bitumen, for example Athabasca or Pelican, Alberta; alternatively it can be whole bitumen where the content of distillables in the bitumen does not justify separately distilling it; or it can be a mixture of these materials.

Figure 1:
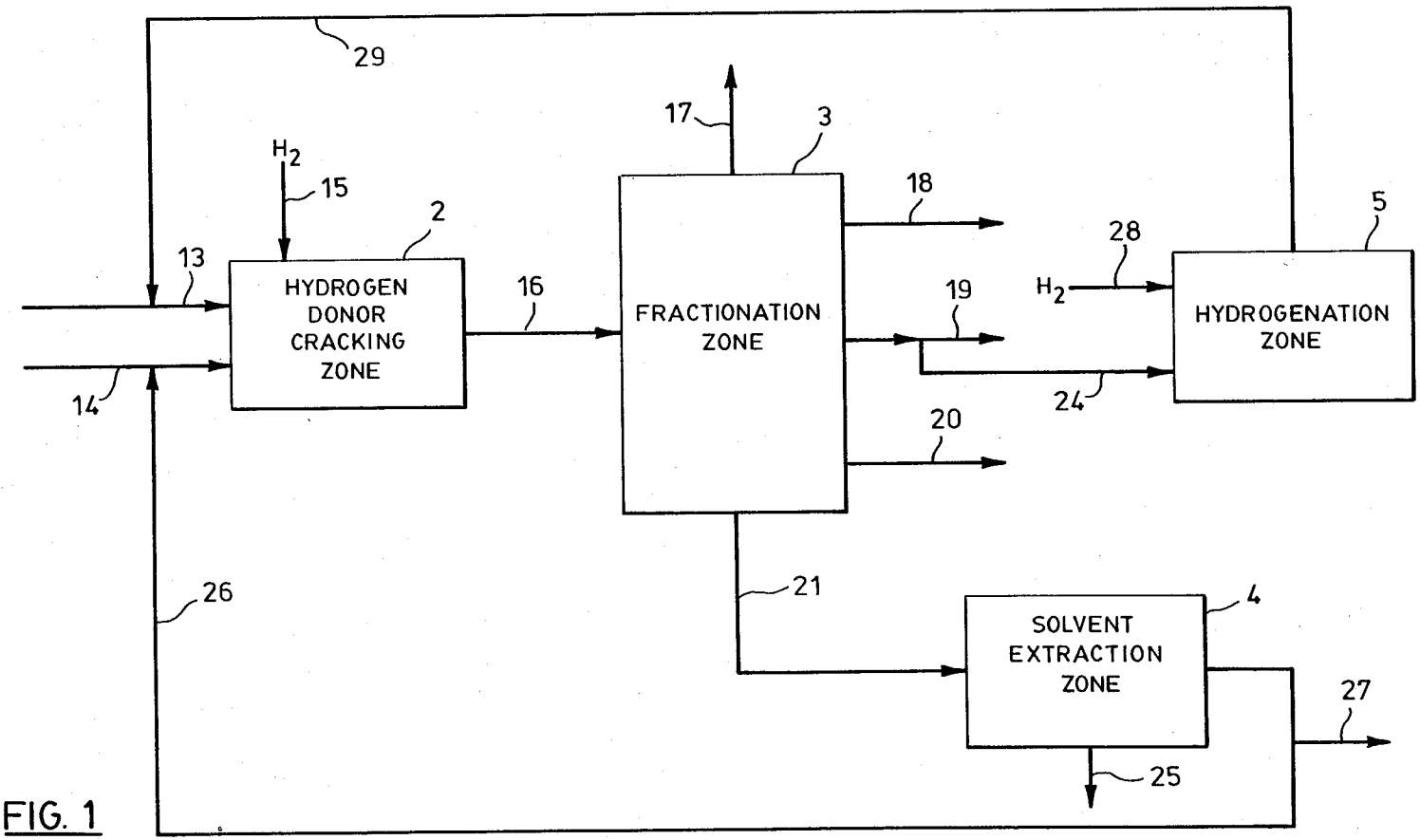
FIG. 1 is a process flow diagram illustrating an industrial application of the process of the invention.

Referring to FIG. 1, a high-boiling hydrocarbon residuum is fed by line 14 to hydrogen donor cracking zone 2. The initial boiling point of this residuum is at least 350° C.; typically, its initial boiling point is in the range 500° C. to 540° C. This residuum is combined with recycle stock, described hereinafter, from line 26 and with hydrogen donor materials from line 13, optionally containing partially hydrogenated recycled donor materials from line 29, and fed to hydrogen donor cracking zone 2. The ratio of hydrogen donor material to residuum can be from about 0.5:1 to 4:1. Optionally, molecular hydrogen is added to donor cracking zone 2 at line 15. The hydrogen donor diluent cracking zone 2 is maintained at a temperature of about 380° C. to 500° C., preferably 400° C. to 460° C., and at an absolute pressure of about 2 MPa to 35 MPa, preferably about 2 MPa to 15 MPa and most preferably 2.5 MPa to 6 MPa if molecular hydrogen is not present; the pressure will preferably be from about 6 MPa to 35 MPa if molecular hydrogen is present. The liquid space velocity of the reaction mass can be from about 0.5 to 30 $h^{-1}$, preferably 0.8 to 7.0 $h^{-1}$. Donor hydrocracking is accomplished in donor cracking zone 2 in the absence of added catalyst.

Effluent from hydrogen donor cracking zone 2 is passed by line 16 to produce fractionation zone 3, which includes an atmospheric pressure fractionation zone and optionally a vacuum fractionation zone. Gases and naphtha are removed by lines 17 and 18 respectively, although it is not necessary for the purposes of the invention to separate gases from naphtha and the two products can be withdrawn in a single overhead line if desired. Hydrocracked distillate in line 19 can be taken to further processing; optionally, at least a portion of the material in line 19, boiling in the range of 200° C. to 400° C., preferably 200° C. to 360° C., can be passed by line 24 to donor rehydrogenation zone 5, which will be described hereinafter. Hydrocracked product residuum boiling above 360° C. is withdrawn by line 21. Under certain circumstances, it may be desirable to withdraw a fraction at line 20, which boils in a range higher than the maximum boiling point of material in line 19 and lower then the minimum boiling point of hydrocracked residuum in line 21. Generally, however, it is convenient not to take out so narrow a gas oil cut between the exhausted donor stream 19 and the hydrocracked residuum stream 21, and thus where no material is withdrawn by line 20, the minimum boiling point of the hydrocracked residuum withdrawn at line 21 is approximately the maximum boiling point of the hydrocracked distillate in line 19. The selection of the cut points of the distillation point is influenced by, among other things, the desired viscosity of deasphalted oil to be produced in deasphalting zone 4.

Where product fractionation zone 3 comprises a vacuum fractionator such that the hydrocracked residuum stream 21 has an initial boiling point of at least 500° C., recycle stock in line 26 inherently boils above 500° C. also, and can be returned directly to the donor hydrocracking zone 2. Also when hydrocracked residuum stream 21 boils above 500° C., it is convenient to withdraw a vacuum gas oil stream at line 20.

Hydrocracked bottoms stream 21 is passed to deasphalting zone 4, where it is contacted with a low-boiling selective solvent, for example, a hydrocarbon containing from 3 to 8 carbon atoms in the molecule. The operation of deasphalting zone 4 can be controlled by the manipulation of several variables well-known to those skilled in the art. The primary consideration in the solvent extraction step is to improve the quality of the recycled stock by selectively rejecting non-upgradable components of the hydrocracked bottoms, including metallic compounds and ash, coke and coke precursors which could not be allowed to build up continuously in a recycled bottoms stream. To meet this objective, the person skilled in the art can manipulate the, among other variables, choice of solvent, including mixed solvents, the ratio of solvent to bottoms in the extraction step, the temperature of extraction and the concomitant pressure required to maintain the solvent in the liquid phase, and the number of stages in the extraction step. The person skilled in the art will be aware that the amount of materials rejected can be decreased by employing a solvent of higher solvent power for high-molecular-weight hydrocarbons; among the aliphatic hydrocarbons, solvent power for these high-molecular-weight materials increases with increasing carbon number of the solvent. Thus, heptane dissolves more high-molecular-weight hydrocarbons than does propane, and aromatic solvents have considerably higher solvent power than heptane. Thus, the solvent preferably comprises aliphatic hydrocarbons containing at most a small proportion of aromatic hydrocarbons, and preferably substantially no aromatic hydrocarbons. A preferred solvent consists essentially of paraffins or olefins in the range C3 to C7; the most preferred solvent in the present invention is butane or pentane or mixtures thereof. It is essential in the process of the invention that the quality of the recycle stock, as measured by the Conradson Carbon Test (CCT), be at least as high as the quality of the original high-boiling hydrocarbon residuum feedstock in line 14 with which it is mixed for processing in the hydrogen donor diluent cracking zone 2. It will be remembered that the Conradson Carbon Test, which is standardized as ASTM D-189, is a measure of the suitability of heavy hydrocarbon oils for various upgrading processes. The person skilled in the art will thus select the parameters of the solvent extraction step to meet this requirement. Within these constraints, a preferred ratio of solvent to hydrocracked bottoms is from about 3:1 to 10:1. Solvent extraction zone 4 is preferably operated at a temperature between about 80° C. and 200° C. and at a pressure sufficient to avoid the formation of substantial amounts of vapours in the extraction zone.

In the solvent extraction zone 4, the hydrocracked residuum from line 21 when mixed with solvent separates into an asphaltenes-rich phase and an oil-rich phase. Solvent is removed from each phase separately by known methods to form an asphaltenes-containing stream 25 which is withdrawn and a deasphalted oil stream 26, which is recycled to the hydogen donor cracking zone 2. A portion of the deasphalted oil stream 26 can be withdrawn by line 27 if desired, but in most cases it will be preferable to recycle the entire stream 26. Generally, it is preferred to treat all of the product tower bottoms in the solvent extraction zone 4.

As mentioned above, middle distillate is withdrawn from fractionation zone 3 in line 19; at least a portion of stream 19, which is rich in hydrogen donor precursors, can be optionally taken by line 24 to rehydrogenation zone 5. Partial rehydrogenation is accomplished by known methods using molecular hydrogen fed by line 28 under elevated temperature and pressure in the presence of known hydrogenation catalysts, for example cobalt, molybdenum, tungsten and nickel compounds and mixtures thereof. Rehydrogenated donor stream 29, which is withdrawn from hydrogenation zone 5, contains significant amounts of compounds capable of donating hydrogen under donor hydrocracking conditions, for example, tetralin and substituted tetralins. The cut points of the fractionation producing hydrogen donor precursor stream 19 and the severity of the hydrogenation in rehydrogenation zone 5 can be adjusted to enable the optimum production of hydrogen-donating materials. Where the boiling range of the hydrogen donor precursor stream is from about 200° C. to 360° C., the stream will contain substantial quantities of materials that, although they are not partially rehydrogenated to produce hydrogen-donating compounds, can be converted when recycled through the donor hydrocracking zone 2, into the precursors of active hydrogen-donating compounds. Thus, on further recycle and partial hydrogenation, at least a portion of these higher-boiling materials can be converted and rehydrogenated to form active hydrogen donors. The higher boiling range of hydrogen donor precursor stream 24 also contains materials that themselves form hydrogen-donating compounds, for example dihydroanthracene, upon partial hydrogenation. It must be remembered, however, that the process of the invention is not dependent upon the recycling of hydrogen donor materials.

Figure 2:
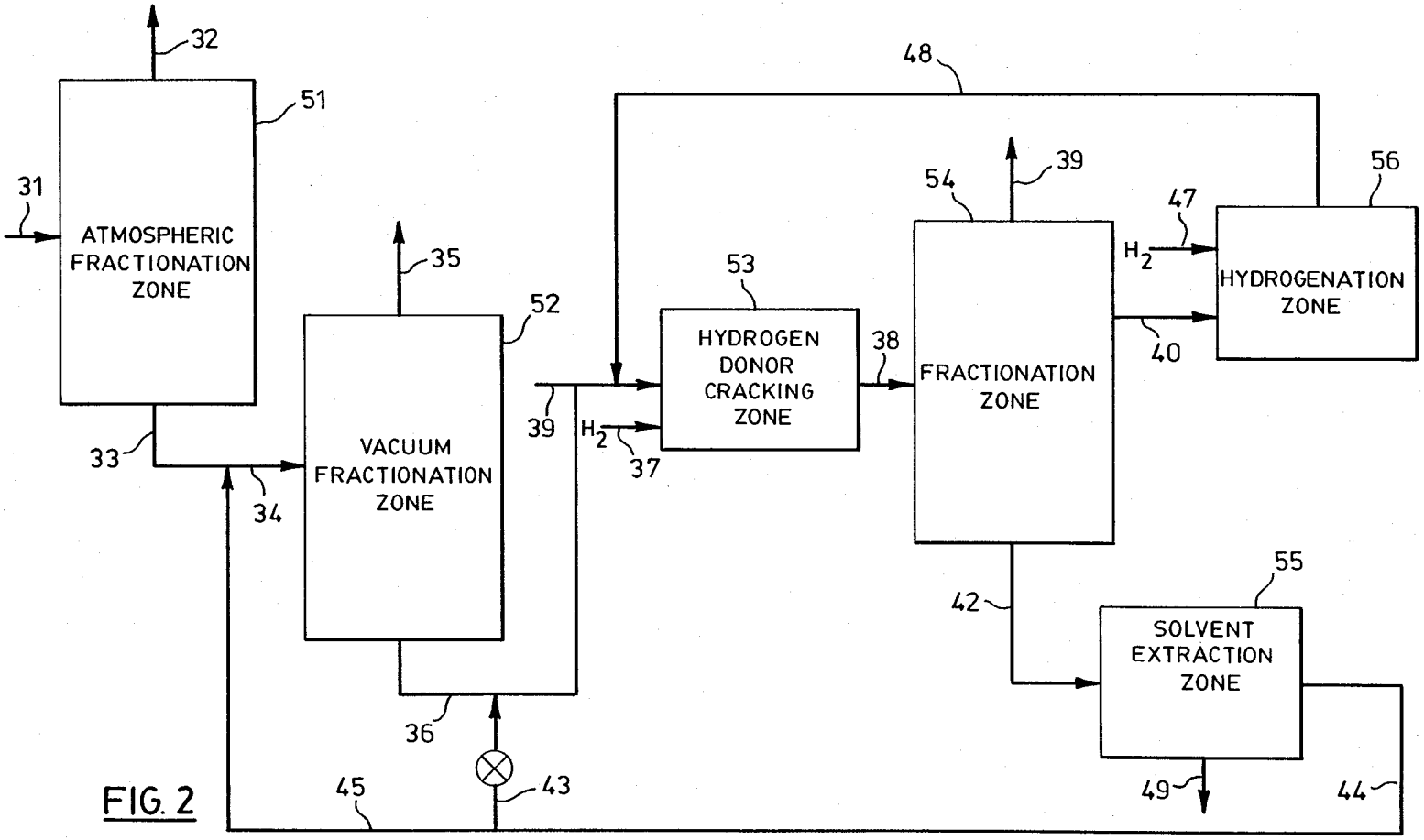
FIG. 2 is a process flow diagram showing a variation incorporating separate atmospheric and vacuum distillation zones.

Referring to FIG. 2, a variant of the preferred embodiment of FIG. 1 is shown wherein separate atmospheric and vacuum fractionation towers are employed for the distillation of the original crude. Crude oil enters atmospheric distillation zone 51 through line 31 and is separated into one or more streams of atmospheric overheads. For the sake of simplicity, the various streams of overheads are shown combined in stream 32. Atmospheric tower residuum is withdrawn by line 33 and mixed with deasphalted oil in line 45 to be fed by line 34 to vacuum fractionating zone 52. One or more streams of distillable materials, shown combined in line 35, are removed to leave a vacuum residue which is withdrawn by line 36. The vacuum residue 36 has an initial boiling point of at least 460° C., preferably at least 500° C.; in commercial practice, vacuum tower residue generally has an initial boiling point no higher than 540° C. The residue in line 36 is mixed with hydrogen donor materials from line 39, and optionally with partially rehydrogenated hydrogen donor stream 48 and passed into donor hydrocracking zone 53, wherein hydrogen donor diluent cracking is carried out at conditions as described above with reference to FIG. 1, optionally in the presence of molecular hydrogen from line 37. A hydrocracked product stream is withdrawn at line 38 and passed to product fractionation tower 54, from which one or more overhead streams shown as 39 are withdrawn. A hydrogen donor precursor stream 40 boiling in the range about 200° C. to 360° C., may be withdrawn and passed if desired to rehydrogenation zone 56, and product fractionation zone residuum, preferably boiling above about 360° C., is withdrawn by line 42 and passed to solvent deasphalting zone 55. Solvent deasphalting zone 55 is operated according to the considerations discussed above. Insoluble asphaltenic residue is withdrawn by line 49 and deasphalted oil recycle stock is returned by lines 44 and 45 to be mixed with atmospheric tower residue from line 33 and passed into vacuum fractionating zone 52 by line 34. Optionally, rehydrogenated donor stream 48 can be prepared by catalytic rehydrogenation of precursor stream 40, described above, in hydrogenation zone 56 to which is fed molecular hydrogen by line 47. Where product fractionation zone 54 is operated at atmospheric pressure and the residuum fed to deasphalting zone 55 has an initial boiling point of about 360° C., it is preferable to feed the recycle stock from line.44 to be vacuum fractionated in vacuum fractionation zone 52 prior to recycling to donor hydrocracking zone 53. Distillable components of the deasphalted oil stream at 44 are thus removed and a second vacuum fractionation zone is avoided; further, the size of donor hydrocracking zone 53 can be minimized. Conversely, if product fractionation zone 54 includes a vacuum fractionation zone, it will usually be preferable to take recycle stock through line 43 directly to donor cracking zone 53. It may be desirable when upgrading some feedstocks, to operate vacuum fractionation zone 52 at conditions in which residuum in line 36 boils above about 540° C., while hydrocracked residuum in line 42 boils above a lower temperature, for example 500° C.

EXAMPLE 1

A full-range Athabasca bitumen was distilled under atmospheric and then under vacuum conditions to yield a vacuum residuum having an initial boiling point of 504° C. and CCT value of 24.6%. All boiling points described herein are corrected to atmospheric pressure. A charge of 334.7 grams of this residuum was mixed with 669.4 grams of a material boiling between 190° C. and 300° C. and containing hydrogen donating species as listed in Table 1. The mixture was charged to a two-liter stirred autoclave which was raised to a temperature of 435° C. for 105 minutes. After cooling, the autoclave pressure was released and the gases collected. The contents of the autoclave were then separated into gases, liquid, residuum and coke products. The yields of the products and their boiling ranges are shown in Table 2. The 88.2 grams of product residuum thus obtained was contacted with a solvent containing primarily pentane, whereby 48.4 grams of deasphalted oil was obtained and 39.8 grams of asphaltenes rejected. In a second stage, the deasphalted oil was further contacted with solvent at a lower temperature, where 10.0 grams of material precipitated, leaving 38.4 grams of second-stage deasphalted oil. The second-stage precipitate, 10.0 grams, was retained as a separate stock for recycle.

TABLE 1

HYDROGEN DONOR DILUENT COMPOSITION

| | (mass percent) |
|---|---|
| Paraffins | 11.2 |
| Cycloparaffins | 5.6 |
| Alkylbenzenes | 14.3 |
| Benzocycloparaffins | 44.2 |
| Benzodicycloparaffins | 7.5 |
| Naphthalenes | 12.5 |
| Naphthocycloparaffins | 3.3 |
| Higher aromatics | 1.4 |

The second-stage deasphalted oil and second-stage precipitate, having a combined CCT value of 19.9%, were mixed with 285.2 grams of fresh vacuum residuum and a further treatment of the mixture having a CCT value of 23.9% was done using the same amount of hydrogen donor and the same autoclave conditions as before. The product yields are also shown in Table 2. The last column in Table 2 shows the change in yield on 100 grams of bitumen residuum for the deasphalted oil recycle, over the yield for the non-recycle case.

TABLE 2

PRODUCT YIELDS - SAMPLE 1

| | Run 1 | Run 2 | Change Run 2 — Run 1 |
|---|---|---|---|
| Feedstock | | | |
| Bitumen Residuum | 100 parts | 85.5 parts | |
| CCT Value | 24.6% | 24.6% | |
| Deasphalted Product Residuum | — | 14.5 parts | |
| CCT Value | — | 19.9% | |

TABLE 2-continued

| PRODUCT YIELDS - SAMPLE 1 | Run 1 | Run 2 | Change Run 2 – Run 1 |
|---|---|---|---|
| Hydrogen Donor Solvent | 200 parts | 200 parts | |
| Processing Conditions | | | |
| Temperature | 435° C. | 435° C. | |
| Time | 105 min. | 105 min. | |
| Yields on Bitumen Feed, % | | | |
| Gas (to C3) | 14.7 | 15.2 | +0.5 |
| Naphtha (C4 to 200° C.) | 49.2 | 58.2 | +9.0 |
| Middle Distillate (200–360° C.) | −12.1 | −15.4 | −3.3 |
| Gas Oil (360–504° C.) | 16.4 | 20.2 | +3.8 |
| Residuum (504° C.+) | 26.4 | 17.1 | −9.3 |
| Coke | 5.5 | 4.7 | −0.8 |
| Conversion to Liquid Products, % | 53.5 | 63.0 | +9.5 |

EXAMPLE 2

A second sample of Athabasca bitumen was hydrocracked to prepare a product residuum having an initial boiling point of 360° C., which was subjected to a solvent extraction treatment by an outside supplier, using a solvent consisting essentially of pentane, the yield was 72.2 percent deasphalted product residuum and 27.8 percent asphaltenes. The deasphalted product residuum was vacuum distilled and the resulting residuum, boiling above 504° C., mixed with bitumen residuum feed in the ratio 17.85 parts to 82.15 parts of bitumen residuum, and subjected to a hydrogen donor solvent hydrocracking step by the same method as Example 1. The original bitumen was a different sample from that of Run 1 and 2, and yielded a different product slate; therefore the original bitumen hydrocracking, Run 3, corresponds to Run 1, while the combined bitumen/deasphalted product residuum material was treated in Run 4, corresponding to Run 2. Results are shown in Table 3.

TABLE 3

| PRODUCT YIELDS - SAMPLE II | Run 3 | Run 4 | Change Run 4 – Run 3 |
|---|---|---|---|
| Feedstock | | | |
| Butumen Residuum II 23.2% | 100 parts | 82.2 parts | |
| CCT Value | 23.2% | 23.2% | |
| Deasphalted Product Residuum | — | 17.8 parts | |
| CCT Value | — | 21.2% | |
| Hydrogen Donor Solvent | 200 parts | 200 parts | |
| Processing Conditions | | | |
| Temperature | 435° C. | 435° C. | |
| Time | 105 min. | 105 min. | |
| Yields on Bitumen Feed, % | | | |
| Gas (to C3) | 16.7 | 15.1 | −1.6 |
| Naphtha (C4-200° C.) | 48.0 | 52.4 | +4.4 |
| Middle Distillate (200–360° C.) | −9.7 | −12.5 | −2.8 |
| Gas Oil (360–504° C.) | 16.2 | 25.6 | +9.4 |
| Residuum | 24.7 | 15.5 | −9.2 |
| Coke | 4.1 | 3.8 | −0.3 |
| Conversion to Liquid Products, % | 54.5 | 65.5 | +11.0 |

For comparison, a sample of each of the second stage deasphalted oil and second-stage precipitate of Run 2 was subjected individually to a hydrogen donor hydrocracking process in the same manner as the previous runs. After treatment with hydrogen donor solvent in the ratio 1:2 feedstock to solvent, the products were fractionated and the conversion of residuum to lliquids was determined. The second-stage precipitate yielded 31.5 percent liquid products, while 46.1 percent of the second-stage deasphalted oil was converted. On a theoretical basis, a mixture in the ratio of 1:3.84 of these two feedstocks would be expected to yield 43.1 percent liquid products; because the residuum of Run 1 was found to yield 54.9 percent deasphalted oil, then theoretically, of the 26.4 percent residuum yield of Run 1, ($26.4\times0.431\times0.549$) or 6.25 percent (absolute basis) can be converted to liquid products. Surprisingly, applicants have found that the improvement in liquid yield by utilizing the process of the invention, at 9.5 percent, is much greater than would be expected by merely combining the two materials, fresh vacuum residuum and deasphalted hydrocracked product residuum. Furthermore, the improvement in liquid yield was accompanied by a decrease in production of coke and a decrease or at the very least only a marginal increase in gases. This change is unexpected in view of the normal tendency of bottoms materials recycled to a hydrocracking reaction to degrade to gas and coke.

The process of the invention provides an improved yield of liquid distillable hydrocarbons superior to the liquids yield which is obtained using hydrogen donor hydrocracking alone. Additionally, while the majority of the metallic constituents in the hydrocracked residuum are rejected with the asphaltenes in the solvent deasphalting step, a small portion of metallic components is present in the deasphalted oil. Returning the deasphalted oil to be reprocessed through the donor hydrocracking zone further breaks down metallic compounds so that the metals are ultimately rejected with the asphaltenes. Being non-catalytic, the donor hydrocracking zone avoids catalyst poisoning that can occur in prior art processes where a metalscontaining oil is fed to a process zone containing a catalyst. Whereas a simple add-on deasphalting step would pass the deasphalted oil with its metallic impurities directly to second-stage hydrotreating units, the process of the invention provides substantially complete rejection of metals and therefore avoids contamination of catalysts in downstream hydrotreating zones.

What is claimed is:

1. A process for converting a feedstock comprising a heavy, high-boiling hydrocarbon oil residuum and a recycle stock to produce lower-boiling hydrocarbons, comprising:

(a) thermally hydrocracking said feedstock with hydrogen donor diluent in a hydrogen donor diluent cracking zone to produce a hydrocracked product stream, (b) fractionating said hydrocracked product stream into at least one distillate fraction and a hydrocracked residuum fraction, (c) contacting said hydrocracked residuum fraction with an extracting solvent to produce (i) a deasphalted oil fraction containing deasphalted oil bottoms fraction having a boiling point of at least 500° C. and (ii) as asphaltenes-rich residue, and (d) directly recycling at least the deasphalted oil bottoms fraction of said deasphalted oil fraction as said recycle stock.

2. A process as claimed in claim 1, further comprising:

(e) fractionating said deasphalted oil fraction into at least one deasphalted oil distillate fraction and a fractionated deasphalted oil bottoms fraction, and (f) recycling said fractionated deasphalted oil bottoms fraction as said recycle stock.

3. A process as claimed in claim 1 or claim 2, wherein said recycle stock has a Conradson Carbon Test value no higher than the Conradson Carbon Test value of said high-boiling residuum.

4. A process as claimed in claim 1 wherein said feedstock consists essentially of hydrocarbon oil residuum.

5. A process as claimed in claim 1 wherein said feedstock is selected from heavy crude oil and oil sands bitumen and residua thereof.

6. A process as claimed in claim 3 wherein said hydrocracked residuum fraction has an initial boiling point at least about 500° C.

7. A process as claimed in claim 3 wherein said hydrocracked oil distillate fraction includes a donor precursor fraction having a boiling range from about 200° C. to 360° C. and at least a portion of said donor precursor fraction is partially hydrogenated in a catalytic hydrogenation zone and recycled to form at least a portion of said hydrogen donor diluent.

8. A process as claimed in claim 1 wherein said feedstock comprises whole crude and is fractionated in a feed fractionation zone comprising an atmospheric feed fractionation zone and a vacuum feed fractionation zone, the residuum from said vacuum fractionation zone being fed to said donor diluent cracking zone.

9. A process as claimed in claim 8 wherein said hydrocracked residuum fraction has an initial boiling point at least about 360° C.

* * * * *